United States Patent [19]

Carll et al.

[11] Patent Number: 4,654,640

[45] Date of Patent: Mar. 31, 1987

[54] DIGITAL PBX INTEGRATED WORKSTATION SECURITY SYSTEM

[75] Inventors: Richard T. Carll, Granby; Barry G. Blackaby, Avon, both of Conn.

[73] Assignee: United Technologies Corporation, Hartford, Conn.

[21] Appl. No.: 804,032

[22] Filed: Dec. 3, 1985

[51] Int. Cl.[4] ..... G08B 13/12; G08B 13/14; G08B 1/08

[52] U.S. Cl. ..... 340/568; 340/533; 340/572; 340/825.36; 370/58; 370/119

[58] Field of Search ..... 340/568, 572, 533, 534, 340/825.36; 370/58, 119

[56] References Cited

U.S. PATENT DOCUMENTS

| | | | |
|---|---|---|---|
| 3,643,250 | 2/1972 | Sander | 340/568 |
| 3,932,857 | 1/1976 | Way et al. | 340/572 |
| 4,000,488 | 12/1976 | Ephraim | 340/572 |
| 4,390,868 | 6/1983 | Garwin | 340/568 |
| 4,551,832 | 11/1985 | Carll et al. | 370/58 |

*Primary Examiner*—Glen R. Swann, III

*Attorney, Agent, or Firm*—Dominic J. Chiantera

[57] ABSTRACT

A theft alarm system for use in combination with a digital signal PBX telephone system, includes a plurality of electronic tethers connected to individual pieces of protected equipment. Removal of the tether is automatically detected by a local security monitor which reports the condition to a central security controller via the PBX system. The security controller then provides dial-up reporting of the theft and/or sets an audible alarm at the equipment site.

6 Claims, 7 Drawing Figures

DIGITAL PBX INTEGRATED WORKSTATION SECURITY SYSTEM

TECHNICAL FIELD

This invention relates to theft alarm systems, and more particularly to an alarm system using a digital PBX telephone system to provide theft monitoring of protected equipment at remote sites.

BACKGROUND ART

Time division multiplexed (TDM) digital PBX telephone systems have not only enhanced voice communication, but have also expanded the utility of a building's installed telephone wiring for performing other functions. In a TDM PBX system, analog-to-digital (and digital-to-analog) conversion occurs in the telephone handset with individual handset codecs. As a result the digital PBX requires only a fraction of the real time required by analog systems and, therefore, is capable of multiplexing data channel information in with the voice channel bit stream.

Typically the PBX provides information exchange between the switch matrix and each system handset through a combined 8 KBPS data channel, a 64 KBPS voice channel, and an 8 KBPS order wire channel. The data channel allows the PBX to provide signal control over unrelated building equipment. This is a control function which would otherwise be impractical due to building rewiring costs. U.S. Pat. No. 4,551,832, of common assignee herewith, discloses one such PBX based control system used to provide central control of HVAC equipment in hotels.

With the advent of desk top computers there have been major capital expenditures by corporations in purchasing workstation equipment, such as word processing equipment and personal computers. This equipment is both expensive and portable. There are prior art security devices, such as cables which secure the equipment in its location, i.e. passive restraint type devices. However, with wide dissemination of the equipment at remote sites throughout company offices, it is desirable to provide some type of automatic theft security.

DISCLOSURE OF INVENTION

The object of the present invention is to provide a theft alarm system for monitoring the security of protected equipment located at remote sites.

According to the present invention, an alarm system includes a security controller card connected to one of a plurality of signal ports of a PBX telephone system matrix, and security monitors located at each site, each connected to each piece of protected equipment at the site by a tether having signal conductors joined in a loop by a conductive element bonded to the equipment, the loop being electrically continuous with the element intact on the equipment and being electrically discontinuous with removal of the element from the equipment, the loop connected to a security monitor signal source which conducts signals through the loop, and connected to a signal detector which detects the presence and absence of the loop signals depending on whether the bonded conductive element is intact or removed, the presence and absence of loop signals are reported by the security monitor through the data channel of the PBX telephone system handsets to the security controller card at the PBX matrix equipment, the security controller monitoring the presence and absence of log signals from various security monitors connected to different telephones in the system, and reporting the absence of any loop signal as a theft alarm at the identified security monitor location.

In further accord with the present invention, the security controller is programmed to transmit a desired bit pattern to each security monitor and to sample each monitor output to determine replication of the pattern, whereby the absence of a replicated pattern indicates a theft which the security controller reports as an alarm condition for the identified monitor, by automatic dial-up to security personnel and, optionally, by a local sonic alarm at the equipment location.

These and other objects, features, and advantages of the present invention will become more apparent in light of the following detailed description of a best mode embodiment thereof, as illustrated in the accompanying drawing.

BRIEF DESCRIPTION OF THE DRAWING

FIGS. *4a–4c* is an illustration of operating waveforms used in describing one aspect of the FIG. 1 embodiment.

BEST MODE FOR CARRYING OUT THE INVENTION

The present security system requires use of a TDM digital PBX telephone system to provide communication between the central security controller and each of the remotely located security monitors. It is suitable for use with any digital PBX in which all system A/D and D/A signal conversion occurs at the station handsets, and all PBX voice, data, order wire, and call processor routing signals are switched through the PBX matrix, such that the PBX system has flexibility in adding security system hardware. These two characteristics are generally common to all current state of the art PBX systems.

The invention best mode embodiment is described with respect to one such state of the art digital PBX which is disclosed and claimed in U.S. Pat. No. 4,612,634 owned by the same assignee, entitled INTEGRATED DIGITAL NETWORK (IDN), issued on Sept. 16, 1986. Only that much of the Bellamy IDN PBX as is necessary to a teaching of the present invention is described herein.

Figure 1:
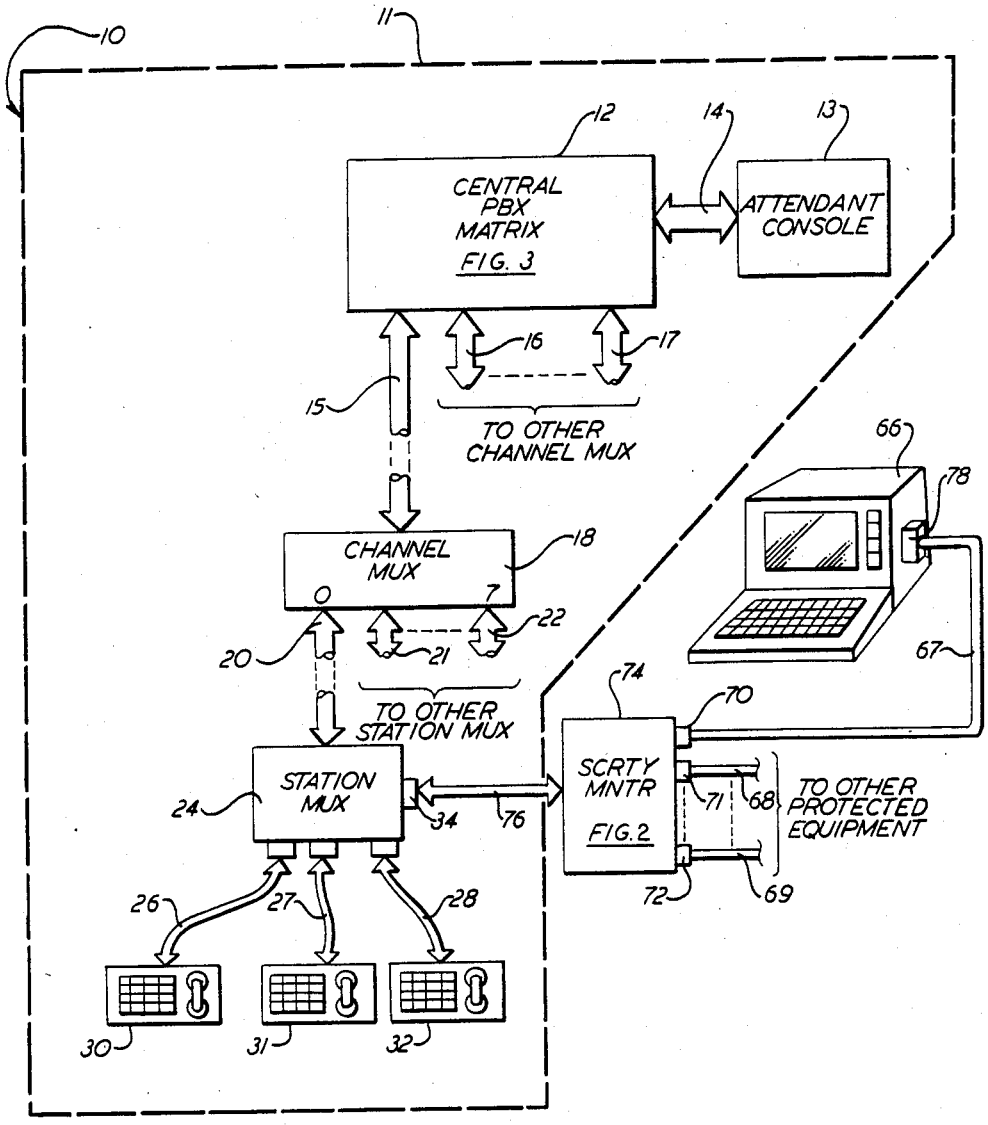
FIG. 1 is a system block diagram illustration of a best mode embodiment of the present invention.

Referring now to FIG. 1, in the digital PBX integrated workstation security system of the present invention 10, a digital PBX system 11 includes a central PBX matrix switch 12 which provides all of the telephone system signal switching. The matrix receives operator inputs through an attendant console 13, on lines 14, and is connected to the system station equipment through input/output (I/O) lines 15–17 to a plurality of channel multiplexers (MUX), such as the channel MUX 18, which in the IDN PBX of Bellamy provides intermediate signal concentration and dissemination as part of a system hierarchy of signal multiplexing/demultiplexing. The channel MUXs exchange high bit rate signals on the I/O lines 15–17 with lower bit rate signals on input lines 20–22 from a plurality of station MUXs such as station MUX 24. The station MUX (SMX) represents the lowest level of signal concentration in the IDN PBX, and each interconnects directly through lines 26–28 with up to three station equipment handsets 30–32.

In addition to providing an auxiliary 8 KBPS simultaneous data channel to each handset, the IDN PBX also provides a separate utility 8 KBPS data channel, independent of the handsets. This utility 8 KBPS channel is available as a dedicated building control channel, and is provided at a separate port 34 of the SMX 24. As a result, the preferred embodiment uses this utility channel for security system communication. It should be understood, however, that the auxiliary channels at each handset may also be used, and would be used absent the availability of such a utility channel.

Figure 4:
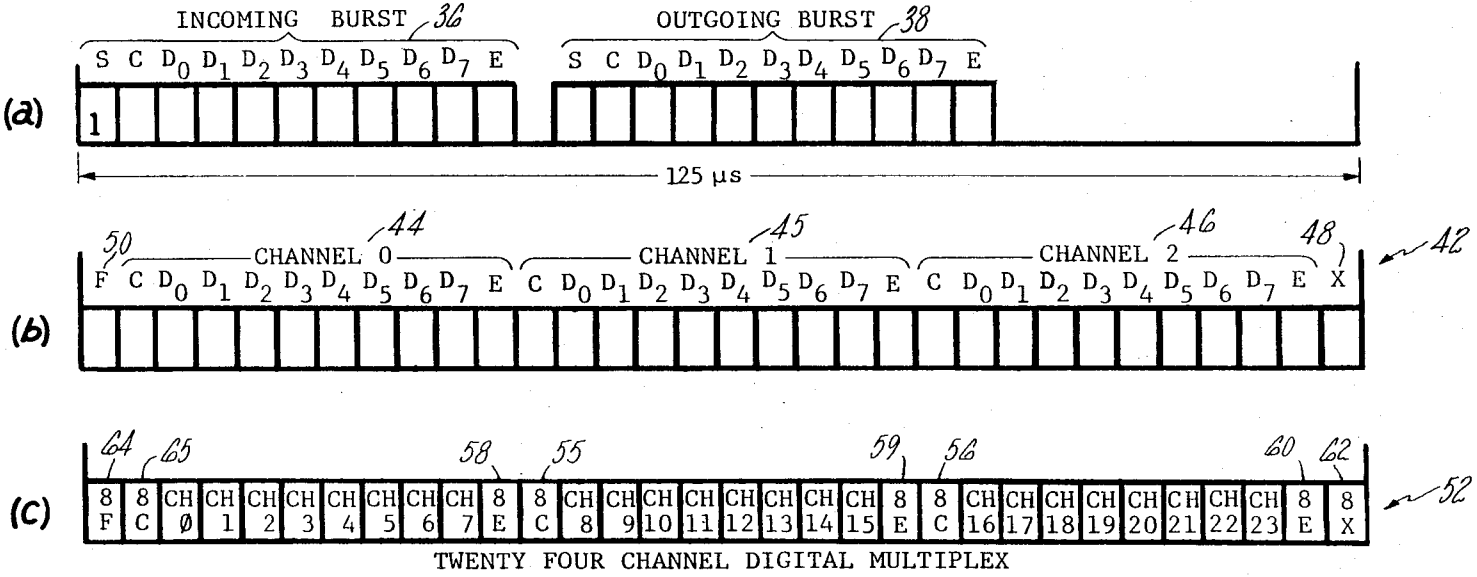

FIG. 4 illustrates the levels of IDN PBX signal concentration between the handsets 30–32 and the matrix 12. Illustration (a) illustrates the ping-pong protocol between the handsets 30–32 and the SMX 24. The station lines 26–28 comprise two pairs of wires; one for digital signal communication and the other for station equipment. The "packet" transmission, i.e. discrete bursts of serial digital signal bits, between the SMX and the handset occurs in a ping-pong protocol. The SMX packets (incoming burst) 36 and the SMX transmitted packets (outgoing burst to the handset) 38 are exchanged in each 8 KHz (125 microsecond) sample period. Each packet is eleven bits, with START (S) bit, order wire bit (C), eight voice message bits ($D_0$–$D_7$), and auxiliary data bit (E).

The SMX receives the 88 KBPS signals from each handset, together with the 8 KBPS utility (X) signal at port 34. The SMX strips the station START bits and multiplexes the three 80 KBPS station signals (64 KBPS voice, 8 KBPS aux data, and 8 KBPS order wire) with the 8 KBPS X bit signal, and with an added clock recovery 8 KBPS FRAME (F) bit, into a 256 KBPS bit stream on line 20 to the channel MUX 18. Waveform 42 of FIG. 4, illustration (b) shows the line 20 format, including the three 64 KBPS station signals 44–46, the 8 KBPS X bit utility signal 48, and the 8 KBPS FRAME bit signal 50.

The 256 KBPS signal from each SMX is multiplexed by the channel MUX 18 together with six other SMX inputs to provide a 2.048 MBPS data stream, as shown by waveform 52 of FIG. 4, illustration (c). The signal is in byte interleaved format with thirty-two 64 KBPS channels in each sample frame, including: twenty-four 8 bit station signal voice channels (CH0–CH23), three composite (from different stations) 8 bit order wire control (C) channels 54–56, three composite auxiliary data (E) channels 58–60, one combined (from each of eight SMXs) 8 bit utility (X) channel 62, and one composite 8 bit FRAME (F) channel 64.

Thus far the description has been of a prior art TDM digital PBX system. In the present invention the PBX is modified by addition of security system hardware and cabling, in the form of a central security controller, a plurality of security monitors, and individual workstation, as described in detail hereinafter. In FIG. 1 the protected equipment 66, e.g. word processor, personal computer, is connected through tethers 67–69 to individual inputs 70–72 of a site located security monitor 74. Each tether is attached to the equipment through a tether connector, such as connector 78 for the tether 68. The monitor is connected through lines 76 to the 8 KBPS utility signal port 34 of the PBX SMX 24.

Figures 2, 5:
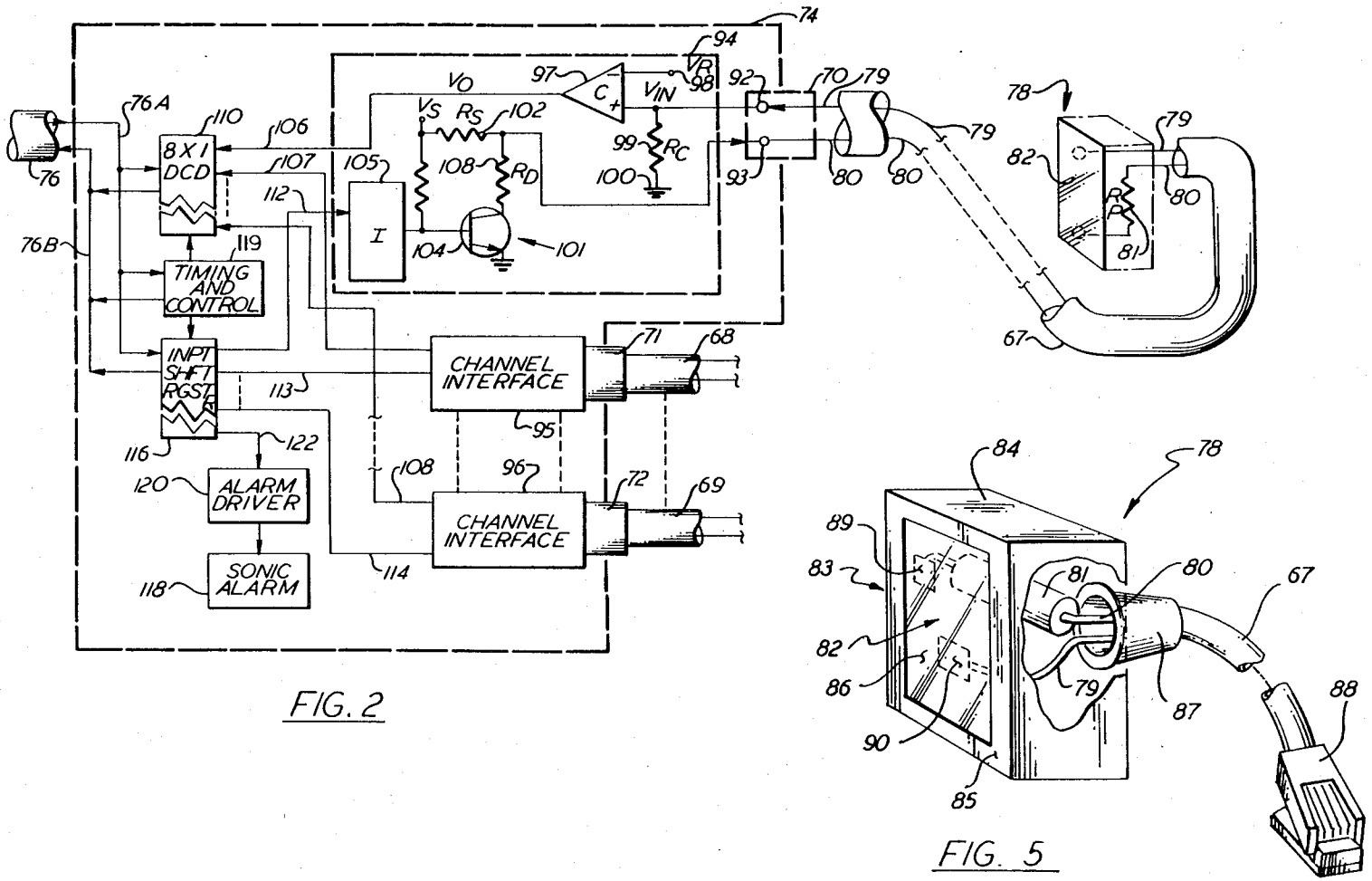
FIG. 2 is a schematic illustration of one element of the embodiment of FIG. 1.
FIG. 5 is a perspective illustration of one component used in the embodiment of FIG. 1.

Referring to FIG. 2, the connector 78, shown schematically, is connected to the chassis or surface of the equipment by bonding. The tethers each include signal conductors, as shown by conductors 79, 80 for the tether 67, which are connected together at one end through a series resistor 81 and a conductive foil 82. In a preferred embodiment the foil has an adhesive backing on an outside mounting surface of the foil, which is adapted for contact with the workstation surface. The connector 78 is then attached to the workstation equipment by the bonding of the adhesive backed mounting surface to the surface of the workstation. The entire connector housing (shown in phantom) is sealed, typically a molded fashion such that there is no access to the foil 82 or resistor 81 once the connector is bonded to the workstation surface.

FIG. 5 is a partially broken away, perspective illustration of one embodiment of the connector 78 attached to one end of tether 67. The connector foil 82 is located on the mounting surface 83 of the housing. The housing includes a mounting flange 85 which surrounds the foil surface 82. Both the foil surface 86 and flange 85 have an adhesive backing. The adhesive is of a known type, having a tensile strength on the order of 400 pounds per unit. The surface area of the flange is selected such that it, in combination with the adhesive strength, it provides a connector mounting which is sufficiently strong to prevent tear away of the connector from the equipment surface under normal use, movement, etc. It is intended that the connector will only tear away with rigorous effort; a level of force which may be determined by those skilled in the art to provide some level of deterence to removal of the connector from the equipment.

The housing 84 provides a sealed, but not necessarily hermetic, enclosure for tether conductors 79, 80, and series resistor 81 (shown in partial breakaway of the housing). A collar 87 may be used to provide a snug tamper-proof connection of the tether to the housing. The tether conductors may be 24 AWG, and may be attached at their other end (i.e. the security monitor inputs 70–72, FIG. 2) to a standard RJ11 telephone plug 88. In an optional tether embodiment, the tether itself may comprise standard two pair, 24 AWG telephone wire in which the added pair of conductors are grounded through plug 88 to the monitor signal ground. In this embodiment, if there is an attempt to short the tether signal conductors with a pin (or similar object) there is an increased likelihood of shorting one or more of the signal conductors to ground, thereby setting an alarm condition, as described hereinafter.

In FIG. 5, the resistor is shown in phantom connected at point 89 and conductor 79 at point 90 to the foil 82. The metal foil is typically 0.010 inch (0.0254 cm) thick aluminum which, as described above, is coated on its outside surface 86 with the adhesive. The adhesive may be applied to the foil by a process similar to that used in the manufacture of aluminum duct tape. The foil is sufficiently thin, such that forcible removal from equipment surface ruptures one or more of the foil connector points (89, 90) to tether conductors 79, 80. This electrical break sets the security system alarm.

The tether signal conductors are connected at the opposite ends to separate terminals of the security monitor inputs 70–72 of a plurality of identical security channels 94–96, as shown by terminals 92, 93 for input 70. As shown schematically by channel 94, each channel includes a comparator 97 with first (inverting) and second (noninverting) inputs connected, respectively, to a reference voltage signal source ($V_R$) 98 and to input terminal 92 of connector 70. The comparator is a known type, such as a Texas Instruments Model TLC 374M. The terminal 92 input includes a compensation resistor ($R_C$) 99 connected to signal ground 100. A current driver circuit 101 is connected to terminal 93 of connector 70. The driver includes series resistors 102, 103 ($R_S$, $R_D$) connected on one end to voltage source ($V_S$) and connected at the other end through a gated switch 104, such as a 2N2222A NPN transistor, to signal ground 100. The switch gate input is provided through INVERT (I) gate 105.

In operation, the current driver 102 sources a current signal (I) through resistors $R_S$ (102), $R_D$ (103), $R_P$ (81) and $R_C$ (99) to ground, with the connector 78 attached to the surface of the workstation equipment. This provides an input voltage ($E_{IN}$) to the noninverting input of comparator 94 which is equal to $E_{IN}=I*R_C$. The magnitude of the current signal I depends on the logic state at the INVERT gate input (described hereinafter), which in turn determines the on/off state of switch 104. If the INVERT gate input is a logic ONE, such that switch 104 is off:

$$I=V_S/R_S+R_P+R_C.$$

If $V_S=+5$ VDC and $R_S=R_P=R_C-1.0K\Omega$, then $I\approx 1.66$ ma. In this case $E_{IN}\approx 1.66$ VDC. If $V_R=+1.5$ V, $E_{IN}$ is greater than $V_R$ and the logic state output of comparator 97 is $V_O$=ONE.

If the INVERT gate input is a logic ZERO, switch 104 is on, and:

$$I=V_S'/R_S'+R_P+R_C,$$

where $$V_S'=V_S*R_D/R_D+R_S,$$

and $$R_S'=R_S*R_D/R_S+R_D.$$

If $R_D=2.0K\Omega$, then $R_S'=0.667$ K$\Omega$, $V_S'=3.33$ VDC, and I=1.25 ma. As a result $E_{IN}=1.25$ VDC, which is less than $V_R$ and the comparator output $V_O$=ZERO.

The comparator output signals from each channel interface circuit are provided on lines 106–108 to separate inputs of a one of eight decoder 110, of a type known in the art such as the Texas Instruments (TI) SN 74151. The decoder provides the monitor interface with the 8 KBPS utility line 76, (dual conductors 76A, 76B). The control input signals to the current drivers in each interface circuit are provided on lines 112–114 from shift register 116, which is a known type, such as the TI SN 7491A. The register input is connected to auxiliary data line 76. Timing and control circuitry 119 provides clock recovery of the PBX matrix master clock, and the security monitor time base. The security monitor also includes, as an option, a local sonic alarm device 118, such as those manufactured by SONALERT®, which is driven by alarm driver circuitry 120 connected through line 122 to the input shift register 116.

Figure 3:
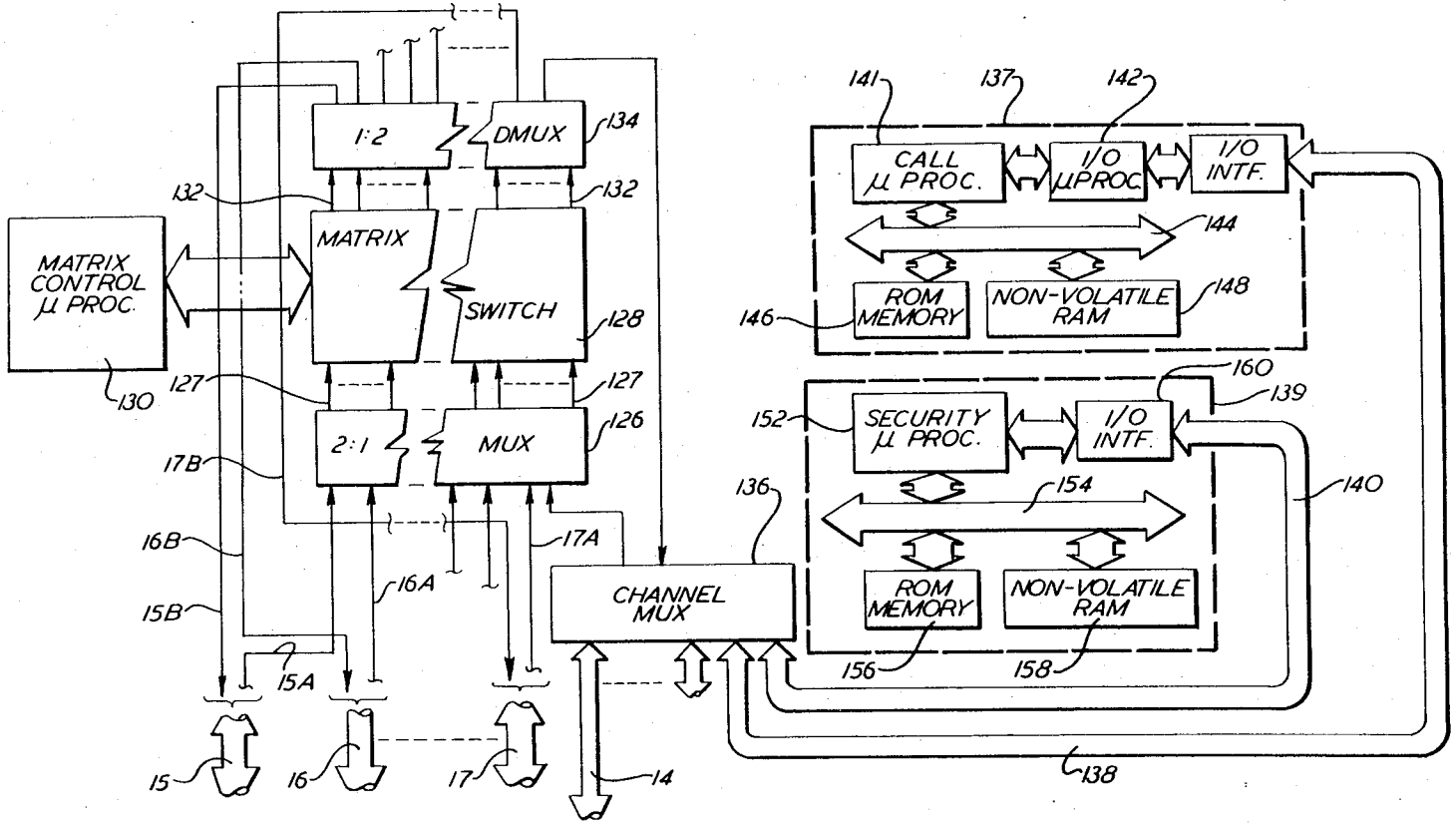
FIG. 3 is a schematic illustration of another element of the embodiment of FIG. 1.

The central security controller is provided as additional hardware in the central PBX matrix 12 (FIG. 1). FIG. 3 is a schematic illustration of that portion of the IDN PBX central matrix as is necessary for a teaching of the present invention. As shown, the I/O lines 15–17 from the channel MUXs (e.g. 18, FIG. 1) are two conductor lines, as shown by conductors 15A, 15B through 17A, 17B. The input lines 15A–17A of the I/O are each connected to individual inputs of a 2:1 MUX 126, which multiplexes every two 2.048 MBPS channel MUX data streams into a 4.096 MBS stream on lines 127 for presentation to the matrix switch 128. The matrix is a time slot interchange (TSI) under control of matrix control microprocessor circuitry 130. The matrix exchanges the incoming information (voice, data, order wire control, and call processor control signals) between the appropriate time slots associated with intended signal destination in the system. The matrix switch output is a 4.096 MBS stream provided on output lines 132 to an output 1:2 demultiplexer (DMUX) 134 which provides 2.048 MBPS outputs on each of the second conductors 15B–17B of each of the I/O lines 15–17.

A unique feature of the IDN PBX is that all signals in the system are switched through the matrix. This includes the order wire bits which control each handset in addition to the matrix overhead signal bits, such as the PBX call processor. The PBX overhead signal bits are interfaced with the matrix through an internal channel MUX 136. This includes all inputs from the attendant console (13, FIG. 1) on lines 14, the signals from the PBX call processor 137 on lines 138, and the output of the security controller 139 on lines 140. The call processor circuitry 137 is located on a separate plug-in module in the main cabinet. As known, the call processor is responsible for setting up and taking down signal connections between the station ports. The circuitry includes a call microprocessor 141 of a type known in the art, such as the Motorola MC 68000 16 bit microprocessor, which is used in conjunction with an input/output (I/O) microprocessor 142, such as the Intel 8051 8 bit microcomputer. The call microprocessor 141 is connected through bus 144 to resident ROM and non-volatile RAM 146, 148.

The central security controller 139 includes a security microprocessor 152, such as an INTEL® 8051, connected through bus 154 to ROM and non-volatile RAM memories 156, 158. An I/O interface 160 provides the exchange of security information over lines 140, through the channel MUX 136 and matrix, to the call processor 137. As stated hereinbefore, all communications in the IDN PBX of Bellamy occurs through the matrix.

In operation, with the workstations secured through the respective tethers (67, FIG. 2) to the associated security monitors, each individual monitor interface channel is activated to provide the security surveillance by operator entry of the workstation identification number through a telephone handset. To activate a particular channel interface the operator dials an assigned telephone extension number which is connected to the security controller 139. The controller responds to the call with an audible acknowledgment, typically three short beeps. Following the acknowledgment the user dials a four digit code through the telephone keypad; the code corresponding to his security channel identification, followed by the asterisk (*) key. This arms the channel interface into the security mode. To de-activate a particular interface, such as when moving the workstation equipment to a different location, the same dialing sequence is followed. The identification number is dialed in through the telephone keypad followed by the pound sign (#) which notifies the security controller to de-activate the security status for that interface.

In the preferred embodiment the security controller provides the alarm monitoring of all the activated channel interfaces by transmitting a selected bit pattern to each SMX having an associated security monitor. The 8 KBPS utility channel transmits the bit pattern, one bit per PBX sample period (125 microseconds), to the input shift register 116 of each security monitor 74 (FIG. 2). This is done through the PBX call processor which is notified by the security controller of those SMXs having activated security monitor channel interfaces. In effect, the security controller tells the call processor to connect the controller to the active security monitor SMXs.

The controller outputs a 16 bit word on the utility channel of each active monitor SMX. The word bit pattern is as follows:

| | |
|---|---|
| 1 1 1 1 1 1 1 1 1 1 1 1 1 1 1 0 | LOGIC STATE |
| 15 14 13 12 11 10 9 8 7 6 5 4 3 2 1 0 | BIT NO. |

The bit stream is shifted through the input shift register 116 (FIG. 2) on successive PBX sample periods, with the logic "0" bit appearing on each of the register output lines 112–114 in each period. A ZERO input to each security channel current driver should result in a $V_O$=ZERO state at the channel's comparator (97, FIG. 2). The comparator output is then returned through the eight to one decode 110 to the utility channel for return to the security controller.

If all eight channels (or all active channels if there are less than eight active channels) are secure (tethers intact), the security controller will receive eight logic "0"s back. Bit No. 8 is then shifted to the input of the first security channel current driver, which responds with a comparator $V_O$=ONE, if its tether is intact. Once again the "1" bit is shifted through each channel on successive sample periods and each comparator output is read. If all eight channels are active and secure, the SEND and RECEIVE word bit pattern at the security controller will appear as follows:

| | |
|---|---|
| 15 14 12 12 11 10 9 8 7 6 5 4 3 2 1 0 | BIT NO. |
| 1 1 1 1 1 1 1 1 1 1 1 1 1 1 1 0 | SEND |
| 1 1 1 1 1 1 1 1 0 0 0 0 0 0 0 0 | RECEIVE |

Bit Nos 0 and 8 correspond to channel 0 (the first of eight); Bit Nos 1 and 9 correspond to channel 1, etc. An open tether connection, or a nonactive channel will cause the corresponding one of the channel's Bit 8–15 position to be a logic "0". A short circuit of the connector resistor $R_P$ will cause the corresponding channel's Bit 0–7 position to be a logic "1". The security controller RAM (158, FIG. 3) includes a look-up table to record the active and inactive channels of each monitor.

The polling of each security monitor by the security controller may be periodic. The sixteen bit word (2 milliseconds) may be transmitted (SEND pattern) to each active monitor every 10 milliseconds. This allows the alarm system transmissions on the 8 KBPS utility channel (or 8 KBPS data channel if appropriate) to be multiplexed with other utility functions. If the controller I/O interface (160, FIG. 3) provides four polling I/Os, each of which poll one SMX monitor each 10 milliseconds, then 400 SMXs may be polled per second, resulting in one second polling of up to 3200 security channels.

Similarly, although the invention has been shown and described with respect to a best mode embodiment thereof, it should be understood by those skilled in the art that the foregoing and various other changes, omissions, and additions in the form and detail thereof may be made therein without departing from the spirit and scope of the invention.

That which we claim as novel and desire to secure by Letters Patent is:

1. Security system apparatus, for use with a time division multiplexed (TDM) digital PBX telephone system of the type having a time slot interchange (TSI) switch matrix with signal ports for exchanging control channel, voice channel and data channel signal bits between those signal ports identified by a PBX call processor, the ports each adapted for connection to telephone signal equipment, for detecting removal of protected equipment from remote site locations, the apparatus comprising:

tether means, one for each protected equipment, each having signal conductors joined at one end by security connector means to provide an electrically continuous loop with said security connector attached to the protected equipment, and to provide an electrically discontinuous loop with removal of said connector from the equipment;

plurality of security monitor means, each connected for response to a group of said tether means and each adapted to exchange data channel signal bits between the data channel of local telephone signal equipment and each of said tether means connected thereto, to determine the presence of said electrically continuous and said electrically discontinuous loop conditions, and to provide security signal indications of each condition to the telephone signal equipment data channel; and security controller means, connected for response to a signal port of the PBX switch matrix and responsive to the PBX call processor and to the data channel signals of the PBX telephone signal equipment, said controller having memory means for storing signals and having signal processing means for receiving, and storing in said memory means, said security signal indications of said discontinuous loop conditions from each of said monitor means, and for providing an alarm signal indication of each.

2. The apparatus of claim 1, wherein said tether means each include a pair of signal conductors; and wherein said security monitor means comprises a plurality of security channel means, one associated with each of said tether means, each including a signal source means for conducting loop signals into one of said tether signal conductors, and each channel means including signal detection means for providing said signal indications of continuous loop and discontinuous loop conditions in response to the presence and absence of said loop signals at the other one of said signal conductors.

3. The apparatus of claim 2, wherein said security controller means is responsive to control channel signal bits received from telephone signal equipment at the direction of the PBX call processor in dependence on entry by an operator of a security code signal at a keypad of such telephone signal equipment, said security code signal indicating a PBX identification of all active monitoring security channels of the monitor associated with the signal equipment, said security controller storing said security code signal for each active monitoring security channel in said memory means, whereby said controller provides said alarm signal indication for a channel in the presence simultaneously of the security channel security code signal and the channel discontinuous loop condition.

4. The apparatus of claim 2, wherein said security connector comprises:

a housing, for receiving said tether signal conductors, and having an equipment mounting surface adapted to receive thereon an electrically conductive foil segment so positioned as to provide said mounting surface with a housing portion and a foil portion, said signal conductors each electrically connected to said foil segment to provide electrical continuity therebetween; and adhesive film, disposed on the exposed surfaces of said housing portion and said foil portion of said mounting surface, for contact bonding said mounting surface to a surface of the protected equipment, said adhesive film having a tensile strength sufficient to maintain said connector in contact with the equipment, and said foil segment having a material strength sufficient to cause destruction of said foil with removal of said connector from the equipment surface, whereby such foil destruction provides electrical discontinuity between said tether signal conductors.

5. The apparatus of claim 4, wherein said foil is aluminum.

6. The apparatus of claim 5, wherein said foil segment has a material thickness not greater than 0.010 inches.

* * * * *